United States Patent [19]

Iding

[11] Patent Number: 4,758,377

[45] Date of Patent: Jul. 19, 1988

[54] VISCOUS PHASE STABLE LIQUID SCOURING CLEANSERS CONTAINING SOLVENT

[75] Inventors: Stephen H. Iding; Richard M. Neel, both of Cincinnati, Ohio

[73] Assignee: The Proctor & Gamble Company, Cincinnati, Ohio

[21] Appl. No.: 45,259

[22] Filed: Apr. 24, 1987

Related U.S. Application Data

[63] Continuation of Ser. No. 779,738, Sep. 24, 1985, abandoned.

[51] Int. Cl.[4] ..... C11D 1/12

[52] U.S. Cl. ..... 252/556; 252/555; 252/559; 252/174.24; 252/174.25; 252/DIG. 2; 252/DIG. 14

[58] Field of Search ..... 252/174.25, 174.24, 252/106, 140, 158, 159, 554, 555, 556, 559, DIG. 14, 174.23, DIG. 2

[56] References Cited

U.S. PATENT DOCUMENTS

| | | | |
|---|---|---|---|
| 1,885,133 | 11/1932 | Oppenheimer | 252/154 |
| 2,257,186 | 9/1941 | Orthner et al. | 252/152 |
| 3,956,158 | 5/1976 | Donaldson | 252/102 |
| 4,129,527 | 12/1978 | Clark et al. | 252/547 |
| 4,158,553 | 6/1979 | Chapman | 51/304 |
| 4,182,686 | 1/1980 | Laks et al. | 252/119 |
| 4,414,128 | 11/1983 | Goffinet | 252/111 |
| 4,457,856 | 7/1984 | Mitchell et al. | 252/166 |

FOREIGN PATENT DOCUMENTS

| | | |
|---|---|---|
| 0040882 | 12/1981 | European Pat. Off. . |
| 2113732 | 3/1971 | Fed. Rep. of Germany . |
| 2009221A | 6/1979 | United Kingdom . |

OTHER PUBLICATIONS

U.S. Ser. No. 654,334, filed Oct. 25, 1984, Siklosi.
U.S. Ser. No. 595,794, filed Apr. 2, 1984, Buzzaccarini.
U.S. Ser. No. 769,811, filed Aug. 23, 1985, Buzzaccarini.

*Primary Examiner*—A. Lionel Clingman
*Assistant Examiner*—Hoa Van Le
*Attorney, Agent, or Firm*—Leonard Williamson; Robert B. Aylor; Richard C. Witte

[57] ABSTRACT

Improved phase stable liquid compositions, particularly for use as hard surface cleansers, comprise a mixture of sodium $C_{12}$–$C_{18}$ paraffin sulfonate (NaPS) and sodium salt of linear alkyl benzene sulfonate (LAS), terpenes, benzyl alcohol, acrylic acid polymeric thickeners, abrasives and viscosity enhancer compounds. The compositions are viscous, substantially phase stable and provide excellent cleaning of both greasy and particulate soils from hard surfaces without streaking or filming.

11 Claims, No Drawings

VISCOUS PHASE STABLE LIQUID SCOURING CLEANSERS CONTAINING SOLVENT

This is a continuation of application Ser. No. 779,738, filed Sept. 24, 1985 and now abandoned.

TECHNICAL FIELD

This invention relates to liquid scouring cleansers. In particular, it relates to viscous, aqueous scouring cleansers containing an abrasive and a binary solvent system. These cleansers are suitable for use as general purpose household cleaning compositions.

BACKGROUND

General purpose household cleaning compositions for hard surfaces such as metal, glass, ceramic, plastic and linoleum surfaces, are commercially available in both powdered and liquid form. Powdered cleaning compositions consist mainly of builder or buffering salts such as phosphates, carbonates, silicates, etc., and although such compositions may display good inorganic soil removal, they are generally deficient in cleaning ability on organic soils such as the grease/fatty/oily soils typically found in the domestic environment.

Liquid cleaning compositions, on the other hand, have the great advantage that they can be applied to hard surfaces in neat or concentrated form so that a relatively high level of surfactant material is delivered directly to the soil. Moreover, it is a rather more straightforward task to incorporate high concentrations of anionic or nonionic surfactant in a liquid rather than a granular composition. For both these reasons, therefore, liquid cleaning compositions have the potential to provide superior grease and oily soil removal over powdered cleaning compositions.

Nevertheless, liquid cleaning compositions still suffer a number of drawbacks which can limit their consumer acceptability. Thus, they generally contain little or no detergency builder salts and consequently they tend to have poor cleaning performance on particulate soil and also lack "robustness" under varying water hardness levels. In addition, they can suffer problems of product form, in particular, phase instability, inhomogeneity, lack of clarity, or inadequate viscosity characteristics for consumer use. Moreover, the higher in-product and in-use surfactant concentration necessary for improved grease handling raises problems of extensive suds formation requiring frequent rinsing and wiping on behalf of the consumer. Although oversudsing may be controlled to some extent by incorporating a suds-regulating material such as hydrophobic silica and/or silicone or soap, this in itself can raise problems of poor product stability and homogeneity and also problems associated with deposition of insoluble particulate or soap residues on the items or surfaces being cleaned, leading to filming, streaking and spotting.

Importantly, liquid cleaners suffer from the disadvantage that they do not contain abrasives, which contribute substantially to the cleaning performance of many dry-powder household and industrial cleaning compositions. Liquid cleansers that do contain abrasives can suffer from phase instability including layering and abrasive settling. This phase instability problem is aggravated when solvents are present in the cleanser compositions.

Terpenes are, per se, well-known components of perfume compositions and are often incorporated into detergent compositions at low levels via the perfume. Certain terpenes have also been included in detergent compositions at higher levels; for instance, German Patent Application No. 21 13 732 discloses the use of aliphatic and alicyclic terpenes as antimicrobial agents in washing compositions; British Pat. No. 1,308,190 teaches the use of dipentenes in a thixotropic liquid detergent suspension base composition. German Patent Application No. 29 09 690 teaches the use of pine oil (a mixture mainly of terpene alcohols) in liquid hard surface cleaning compositions.

European Application No. 81-200540.3 teaches the use of terpenes with solvents such as benzyl alcohol and ethylene glycol dibutyl ether in liquid cleanser compositions. European Application No. 82-201396.7 teaches the use of terpenes and butyl carbitol (a trademark for 2-(2-butoxyethoxy)ethanol) in a liquid cleanser, optionally with particulate zeolite builders.

However, the use of the combination of selected terpenes, polar solvents, selected surfactant mixture, abrasive with polymeric acrylic acid thickeners and viscosity enhancers disclosed herein does not appear to have been considered, heretofore.

SUMMARY OF THE INVENTION

The compositions herein may be succinctly described as viscous, phase stable liquid scouring cleaners which comprise 1–10% of a surfactant mixture of paraffin sulfonate (NaPS) and alkyl benzene sulfonate (LAS), 0.5–10% of a terpene or a terpene derivative, or mixtures thereof; 0.5–3% of a polar solvent (benzyl alcohol); 0.4–1% of a high molecular weight acrylic polymeric thickener; and from 1–50% of a water-insoluble abrasive of the type described hereinafter; and 0.03–0.5% of selected viscosity enhancing compounds.

DETAILED DESCRIPTION OF THE INVENTION

The essential terpene, benzyl alcohol, abrasive, thickener, selected surfactant components, and other ingredients used in the practice of the present invention are described in more detail, hereinafter. All percentages and ratios mentioned in this specification are by weight, unless otherwise stated.

It has now been discovered that the defects of prior art liquid cleansers can be minimized or overcome through the incorporation therein of a specified mixture of surfactants, acrylic acid polymeric thickeners, and selected terpenes, viscosity enhancers of the alcohol, nitrile, ketone and aldehyde classes as defined herein, in combination with benzyl alcohol, and with an abrasive.

The present invention provides abrasive-containing liquid cleaning and scouring compositions which have excellent phase stability and suds control across a broad range of usage and water hardness conditions and which provide excellent shine performance together with improved cleaning characteristics both on greasy/oily soils and on inorganic particulate soils, with little tendency to cause filming or streaking on washed surfaces. Importantly, the abrasives used herein are soft, preferably having a Mohs hardness of 3 or less.

Terpenes

Terpenes, as a solvent class, have limited water-solubility. They can be incorporated into liquid cleaning compositions in homogeneous form, even under "cold" processing conditions, with the ability to provide excellent cleaning characteristics across the range of water hardness on grease/oily soils and inorganic particulate soils, as well as on shoe polish, marker ink, bath tub soil, etc., and excellent shine performance with low soil redeposition and little or no propensity to cause filming, streaking or spotting on surfaces washed therewith. Moreover, the terpenes herein specified, and in particular those of the hydrocarbon class, are valuable in regulating the sudsing behavior of the instant compositions in both hard and soft water and under both diluted and neat or concentrated usage.

Preferred terpenes for odor impact are mono- and bicyclic monoterpenes, especially those of the hydrocarbon class, which include the terpinenes, terpinolenes, limonenes and pinenes, and mixtures thereof. Highly preferred materials of this type are d-limonene, dipentene, alpha-pinene, beta-pinene and the mixture of terpene hydrocarbons obtained from the essence of citrus (e.g., cold-pressed orange terpenes and orange terpene oil phase ex fruit juice). These terpenes are used at concentrations of at least 0.1%, preferably 0.5%–5%, most preferably 1–3%, in the compositions for fragrance and cleaning effects. The weight ratio of surfactant:terpene preferably is between 20:1 and 3:2, more preferably 4:1 to 1.5:1.

Viscosity Enhancers

As mentioned hereinbefore, a special problem for thickened liquid scouring cleansers is achieving a stable, high viscosity product. It has been surprisingly discovered that certain alcohol, aldehyde, nitrile, acetate and ketone compounds having VE empirical formulas of $C_nH_mR$ where n=10 or 12; m=14, 16, 17, 18 or 20 and R=O, $O_2$ or N, are viscosity enhancers (VE) when used in conjunction with the high molecular weight acrylic acid polymeric thickeners. Some preferred VE compounds are selected from citronellol, geraniol, linalool, nerol, rhodinal, alpha-terpineol, beta-citronellol, rhodinol, citronella nitrile, carvone, fenchone, menthol, isoborneol and mixtures thereof. These preferred VE compounds are commercially available. These VE compounds are used in the compositions of this invention at concentrations of from about 0.03% to about 0.5%, more preferably from about 0.05% to about 0.25%.

Polar Solvent

The polar solvent of this invention has a water solubility at 25° C. in the range of from about 0.2% to about 10% and is used at a level of from about 0.5% to about 3%. See U.S. Pat. No. 4,414,128 for a list of such polar solvents. Benzyl alcohol ($C_6H_5CH_2OH$), the preferred polar solvent, is used in the compositions at concentrations of at least 0.1%, preferably 0.5–3%, most preferably 1–2%. This polar solvent increases the cleaning power of the compositions.

The weight ratio of terpenes to benzyl alcohol is preferably in the range from 5:1 to 1:5, most preferably 2:1 to 1:2.

Abrasive

The abrasive is used at a level of 1–50% (preferably 5–40%; most preferably 10–35%). The abrasives employed herein are selected from water-insoluble, mild abrasive materials. It is highly preferred that the abrasives used herein not be undesirably "scratchy." Abrasive materials having a Mohs hardness in the range of about 7, or below, are typically used; abrasives having a Mohs hardness of 3, or below, can be used to avoid scratches on aluminum or stainless steel finishes. Suitable abrasives herein include inorganic materials, especially such preferred materials as calcium carbonate and diatomaceous earth, as well as materials such as Fuller's earth, magnesium carbonate, China clay, attapulgite, calcium hydroxyapatite, calcium orthophosphate, dolomite and the like. Organic abrasives such as urea-formaldehyde, polyvinyl chloride, methyl methacrylate and melamine-formaldehyde resins can also be used, preferably at a level of 5–15%. The organic abrasives are more compatible with detergency builders and sequestrants.

It is preferred that the abrasives herein have a particle size range in the 100–600 U.S. Sieve Series Mesh, preferably 200–400 U.S. Sieve Series Mesh, size. Diatomaceous earth and calcium carbonate are commercially available in the 5–150 micron particle size range, and, as will be seen hereinafter, give excellent cleaning performance. The preferred abrasive is commercially available as Georgia Marble RO-4 Ground Calcium Carbonate.

Surfactants

The selected combination of NaPS and LAS has been found to provide superior phase stability in the cleansers of this invention. The selected water-soluble detersive surfactant useful herein is a mixture of linear alkyl benzene sulfonates (LAS) and paraffin sulfonates (NaPS). In general, such detersive surfactants contain an alkyl group in the $C_{10}$–$C_{18}$ range; the selected surfactants are most commonly used in the form of their sodium, potassium or triethanolammonium salts. The $C_{11}$–$C_{16}$ alkyl benzene sulfonates and the $C_{12}$–$C_{18}$ paraffin sulfonates are selected for the compositions of the present invention. As used herein, the abbreviations "LAS" and "NaPS" include these broader surfactant definitions, unless otherwise specified.

The compositions herein generally will contain about 1% to about 10%, preferably 2% to about 8%, more preferably 2.5–5%, of the surfactant mixture. The mixture has a ratio of NaPS to LAS of from 20:1 to 2:1, preferably 10:1 to 2:1, and more preferably from 7:1 to 4:1.

Thickeners

The selected thickeners of this invention are the high molecular weight polyacrylates which have molecular weights of about 0.5–1.5 million with preferably some crosslinking of about 1–4%. Examples of suitable thickeners are (1) Sokalan PHC-25 ex BASF; (2) Acrysol ICS-1 ex Rohm and Haas (works best at high pH 11.9); and (3) Carbopol 941 ex B. F. Goodrich. Carbopol 941 works well but leaves a film when rinsed after product use. The thickeners of this invention are employed at 0.4–1%, preferably 0.45–0.75% by weight of the composition.

The compositions herein must be thickened for dispersion and phase stability at the 1800–4000 cps viscosity range. The compositions of this invention preferably have a viscosity in the 2000–3500 cps range, as measured with a standard Brookfield Viscometer. Thickened compositions tend to cling to vertical surfaces such as walls and windows, which makes them more convenient to use.

pH

The compositions herein are formulated in the alkaline pH range, generally in the range of pH 8–12, preferably about 10–11.5 to avoid hydrolysis of some perfume components. Caustics such as sodium hydroxide and sodium carbonate can be used to adjust and buffer the pH, as desired. An alkaline pH is also essential in obtaining the specified viscosity.

Soaps

As mentioned hereinabove, one special problem associated with the use of liquid cleansers is their tendency to over-suds in use. It has been discovered that soaps, especially the alkali, ammonium and alkanolammonium salts of $C_{12}$–$C_{24}$ fatty acids, are especially useful as suds suppressors when conjointly present with terpenes and benzyl alcohol in the instant compositions. Soap concentrations of at least about 0.005%, preferably 0.05% to 0.4%, provide this important suds control function. Soap prepared from coconut oil fatty acids is preferred.

Other Ingredients

The compositions herein can contain other ingredients which aid in their cleaning performance. Conventional additives such as detergency builders, water softeners, carrier liquids (especially water), perfumes, and the like can be used. For example, it is highly preferred that the compositions with organic abrasives contain a detergent builder and/or metal ion sequestrant. Compounds classifiable and well known in the art as detergent builders include the nitrilotriacetates, polycarboxylates, citrates, water-soluble phosphates such as tripolyphosphate and sodium ortho- and pyrophosphates, silicates, and mixtures thereof. Metal ion sequestrants include all of the above, plus materials like ethylenediaminetetraacetate, the amino-polyphosphonates and phosphates (DEQUEST) and a wide variety of other poly-functional organic acids and salts too numerous to mention in detail herein. See U.S. Pat. No. 3,579,454 for typical examples of the use of such materials in various cleaning compositions. In general, the builder/sequestrant will comprise about 1% to about 25% of the composition. Colorants and perfumes can be used with all abrasives.

Moreover, the compositions herein can contain, in addition to ingredients already mentioned, various optional ingredients typically used in commercial products to provide aesthetic or additional product performance benefits. Typical ingredients include perfumes, dyes, optical brighteners, soil suspending agents, detersive enzymes, gel-control agents, freeze-thaw stabilizers, bactericides, preservatives, and the like. Nonionic surfactants at a level of 0.2–0.5% are excellent freeze-thaw stabilizers.

The compositions herein typically contain up to about 90% water as a carrier. Water-alcohol (e.g., ethanol, isopropanol, butanol, etc.) mixtures can also be used.

Since the compositions herein are in liquid form, they can be prepared by simply blending the essential and optional ingredients in the aqueous carrier.

The following examples are given by way of illustrating the compositions herein, but are not intended to be limiting to the spirit and scope of the invention.

EXAMPLE 1

| Component | Concentration in Cleanser |
|---|---|
| Thickener | |
| Sokalan PHC-25 | 0.67% |
| Surfactants | |
| NaPS | 3.0% |
| LAS | 0.6% |
| Neodol 45-7 | 0.30% |
| Solvent | |
| Benzyl Alcohol | 1.30% |
| Perfume Mix #1 | |
| Citrus Terpenes | 1.85% |
| Citrus Phase Oil | 0.15% |
| Other Components | 0.15% |
| Abrasive | |
| $CaCO_3$ (Avg. 50–60 microns) | 30.0% |

-continued

| Component | Concentration in Cleanser |
|---|---|
| Other | |
| $Na_2CO_3$ | 3.0% |
| Dye | 0.005% |
| NaOH | 0.5% |
| Coconut/Lauric Fatty Acid | 0.2% |
| Water | To Balance |

Definitions

NaPS: Sodium $C_{13}$–$C_{16}$ paraffin sulfonate

LAS: Sodium salt of linear $C_{11.8}$ alkyl benzene sulfonate

Perfume Mix #1: The "Other Components" of the perfume mix #1 contain 50–60% viscosity enhancing compounds of alcohol, nitrile and aldehyde of the $C_{10}H_{20}O$, $C_{10}H_{17}N$ and $C_{10}H_{18}O$ formulas.

Neodol 45-7: A condensate of one mole of $C_{14}$–$C_{15}$ fatty alcohol with 7 moles of ethylene oxide.

EXAMPLES 2 AND 3

Impact of Terpenes on Product Viscosity

Examples 2 and 3 were made in 2000 gram batches using a Lightening mixer. The ingredients were added in the order in which they appear. A viscosity reading was recorded 5 minutes after each ingredient was added.

| | Example 2 | | Example 3 | |
|---|---|---|---|---|
| Ingredient | Formula | Viscosity | Formula | Viscosity |
| Soft water | 59.00% | — | 58.00% | — |
| Sokalan PHC-25 | 0.65% | 100 cps | — | — |
| Acrysol ICS-1 | — | — | 0.98% | 25 cps |
| Anionic surfactant* | 2.8% | — | 2.8% | — |
| Neodol 45-7 | 0.5% | 400 cps | 0.5% | 50 cps |
| Benzyl alcohol | 1.5% | — | 1.5% | — |
| Lauric fatty acid | 0.10% | — | 0.10% | — |
| Coconut fatty acid | 0.10% | 25 cps | 0.10% | 25 cps |
| NaOH | 0.25% | 550 cps | 0.25% | 225 cps |
| $Na_2CO_3$ | 3.00% | 250 cps | 3.00% | 150 cps |
| $CaCO_3$ | 30.00% | 1250 cps | 30.00% | 1500 cps |
| Perfume mix** | 2.15% | 2750 cps | 2.15% | 2700 cps |

*NaPS/LAS ratio 5:1.

**The perfume mix #1 comprises organic compounds which contain about 3–4 parts citronellol, citronella nitrile and dihydro mercinol. This amount provides about 0.06–0.09% of viscosity enhancers by weight of the total composition.

Note in Examples 2 and 3 that the addition of the viscosity enhancing perfume mix had a profound impact on product viscosity. Without the perfume mix, the formulations would experience abrasive settling and layering and have viscosities of only 1250 and 1500 cps vs. 2750 and 2700 cps, respectively.

EXAMPLES 4–14

Impact of Selected Compounds on Product Viscosity

Base Formula I

| Ingredient | Wt. % |
|---|---|
| Soft Water | Balance |
| Sokalan PHC-25 | 0.65 |
| Anionic surfactant* | 3.6 |
| Neodol 45-7 | 0.50 |
| Benzyl alcohol | 1.3 |
| Lauric fatty acid | 0.1 |
| Coconut fatty acid | 0.1 |
| NaOH | 0.2 |
| $Na_2CO_3$ | 3.0 |

-continued

| Ingredient | Wt. % |
|---|---|
| $CaCO_3$ | 30.00 |
| Colorant | 0.01 |
| Citrus terpenes | 2.00 |

*NaPS/LAS ratio 5:1.

Selected Compounds

| Example | | |
|---|---|---|
| 4 | 0.15% Citronellol | 5350 cps |
| 5 | 0.15% Dihydro Mercinol | 4900 cps |
| 6 | 0.15% Citronellal | 3500 cps |
| 7 | 0.15% Citronella Nitrile | 3000 cps |
| 8 | 0.15% Fenchyl Acetate | 2300 cps |
| 9 | 0.15% Linalyl Acetate | 2250 cps |
| 10 | 0.15% Camphene | 1750 cps |
| 11 | 0.15% Alpha-Pinene | 1650 cps |
| 12 | 0.15% Eucalyptol | 2050 cps |
| 13 | 0.15% Para Cymene | 1700 cps |
| 14 | 0.15% Terpinolene | 1800 cps |

The base Formula I has a viscosity of 1900 cps. The selected compounds of Examples 4–14 were added separately to the base Formula I and the viscosity measured. The compounds of Examples 4–7 show profound impact on viscosity enhancement. The compounds of Examples 8 and 9 show marginal improvement. The compounds of Examples 10–14 show little or reduced viscosity impact.

Other VE compounds of the empirical formulas, e.g., menthol, isoborneol, carvone and fenchone, were found to produce a profound inpact on viscosity of Base Formula I.

EXAMPLES 15–20

Impact of LAS on Viscosity

Base Formula II

| Ingredient | Wt. % | |
|---|---|---|
| Soft water | Balance | |
| Acrysol ICS-1 | 0.49 | |
| Surfactant: | | |
| NaPS | Variable | see below |
| LAS | Variable | see below |
| Benzyl alcohol | 1.5 | |
| NaOH (50%) | 0.25 | |
| $Na_2CO_3$ | 3.00 | |
| $CaCO_3$ (same as above) | 30.00 | |
| Perfume mix #1 | 2.15 | |

| Examples: | 15 | 16 | 17 | 18 | 19 | 20 |
|---|---|---|---|---|---|---|
| NaPS concentration | 2.8% | 2.8% | 2.8% | 2.8% | 2.8% | 3.5% |
| LAS concentration | 0.3 | 0.4 | 0.5 | 0.6 | 0.7 | — |
| Viscosity (cps) | 1400 | 1900 | 2100 | 2500 | 3150 | 1500 |
| Stability: | Top Layer | OK at room temp. only | OK | OK | OK | Abrasive settles |

The above data show that combinations of NaPS and LAS have synergistic benefits for viscosity enhancement, as well as phase stability.

What is claimed is:

1. An improved phase stable liquid scouring cleanser composition consisting essentially of:
   (a) from about 1% to about 10% of a synthetic surfactant mixture of paraffin sulfonate (NaPS) and linear alkyl benzene sulfonate (LAS), said mixture of NaPS and LAS having a ratio of from 20:1 to 2:1;
   (b) from about 0.5% to about 5% of a mono- or sesquiterpene or mixtures thereof, the weight ratio of surfactant:terpene lying between 20:1 to 3:2;
   (c) from about 0.5 to about 3% of benzyl alcohol;
   (d) from about 0.03% to about 0.5% of a viscosity enhancing compound selected from the group consisting of citronellol, geraniol, dihydro mercinol, linalool, nerol, rhodinal, alphaterpineol, beta-citronellol, rhodinol, citronella nitrile, carvone, fenchone, menthol, isoborneol and mixtures thereof;
   (e) from about 1% to about 50% of a water-insoluble abrasive; and
   (f) from about 0.40% to about 1% of a high molecular weight acrylic acid polymeric thickener having a molecular weight range of about 0.5 million to about 1.5 million; and wherein the viscosity of said composition is from about 1800 to about 4000 cps at room temperature and wherein the pH of said composition is from 8 to 12.

2. The composition of claim 1 wherein the ratio of said mixture of NaPS and LAS is from 10:1 to 2:1 and is present in said composition at a level of from 2% to 8%.

3. The composition of claim 1 wherein the ratio of said mixture of NaPS and LAS is from 7:1 to 4:1 and is present at a level of about 2.5% to about 5%.

4. The composition in accordance with claim 1 wherein the terpene is selected from d-limonene, dipentene, alpha-pinene and beta-pinene, and mixtures thereof, and is present at a concentration of 1% to 3% and wherein the weight ratio of surfactant mixture to terpene is 4:1 to 1.5:1.

5. The composition in accordance with claim 1 wherein said (d) is present at a concentration of 0.05 to 0.5%.

6. The composition in accordance with claim 1 wherein the weight ratio of terpene to benzyl alcohol is in the range of from 5:1 to 1:5.

7. The composition in accordance with claim 1 containing from 1% to 2% by weight of benzyl alcohol and wherein the ratio of terpene to benzyl alcohol is from about 2:1 to about 1:2.

8. A composition in accordance with claim 1 wherein (d) is selected from citronellol, dihydro mercinol, citronellal and citronella nitrile and mixtures thereof and is present at a level of 0.05% to 0.25% of said composition.

9. A composition in accordance with claim 1 containing from 5% to 40% of an abrasive having a particle size range of 5–150 microns, said abrasive having a Mohs hardness of 7 and below.

10. A composition in accordance with claim 9 wherein said abrasive is present at a level of 10% to 35%.

11. A composition in accordance with claim 1 containing from 0.45% to 0.75% of said acrylic acid polymeric thickener and wherein said viscosity is from 2000 to 3500 and wherein said pH is 10 to 11.5.

* * * * *